US006675750B1

(12) United States Patent
Wagner

(10) Patent No.: US 6,675,750 B1
(45) Date of Patent: Jan. 13, 2004

(54) CYLINDER LINER

(75) Inventor: Jay Wagner, Ann Arbor, MI (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/132,114

(22) Filed: Apr. 25, 2002

(51) Int. Cl.[7] ..... F02F 1/10
(52) U.S. Cl. ..... 123/41.84; 123/41.79
(58) Field of Search ..... 123/41.83, 41.84, 123/41.79, 41.81, 193.2

(56) References Cited

U.S. PATENT DOCUMENTS

| | | | | |
|---|---|---|---|---|
| 3,481,316 A | 12/1969 | Olson et al. | ..... | 123/41.84 |
| 4,706,616 A | 11/1987 | Yoshimitsu | ..... | 123/41.84 |
| 4,794,884 A | 1/1989 | Hilker et al. | ..... | 123/41.79 |
| 4,926,801 A | 5/1990 | Eisenberg et al. | ..... | 123/41.84 |
| 5,199,390 A | 4/1993 | Hama et al. | ..... | 123/41.84 |
| 5,207,189 A | 5/1993 | Kawauchi et al. | ..... | 123/41.84 |
| 6,357,400 B1 * | 3/2002 | Bedwell et al. | ..... | 123/41.84 |

* cited by examiner

*Primary Examiner*—Noah P. Kamen
(74) *Attorney, Agent, or Firm*—Rader, Fishman & Grauer PLLC

(57) ABSTRACT

The subject invention is a cooling system of an internal combustion engine having a wet-sleeve cylinder liner that improves heat reduction efficiency as compared with traditional cylinder liners. The improved liner has an outer surface with a plurality of peaks and valleys. The peaks and valleys create an increased surface area of the outer surface thereby increasing contact with a cooling medium and more efficiently reducing heat within the engine. The peaks and valleys are positioned along the entire length of the cylinder liner and are generally arcuate in a sinusoidal pattern. The liner also includes an inner surface of the liner that remains generally planar for receiving a piston. Finally, one end of the liner also includes a flange for mating the liner to a counterbore of the engine.

16 Claims, 2 Drawing Sheets

CYLINDER LINER

BACKGROUND OF THE INVENTION

1. Field of the Invention

The present invention relates to a cooling system employing a wet sleeve cylinder liner and more specifically a cylinder liner having an outer surface with a plurality of peaks and valleys to increase the overall outer surface area of the liner and improve cooling efficiency 2. Description of the Related Art The automotive industry continually demands increased horsepower from vehicle engines. Unfortunately, a direct correlation exists between increased horsepower and heat production by the engine. The presence of heat in an internal combustion engine adversely affects many different components. The continual heat up and cool down of the engine results in the breakdown of components such as gaskets and seals thereby reducing their overall useful life. Additionally, increased heat in a combustion chamber results in the creation of nitrogen oxide. Nitrogen oxide is a pollutant targeted for reduction by the Environmental Protection Agency and Corporate Average Fuel Economy standards developed by the Department of Transportation. Furthermore, an increase in engine temperature requires the upgrade of cooling systems and components such as water pumps and coolers. When these components are upgraded and increased in size, the parasitic drag of the vehicle is also increased and fuel economy is adversely affected.

The greatest concentration of heat produced by an engine is in the combustion chamber. Therefore, to eliminate heat overall from the engine it is best to target heat removal from the combustion chamber area. The chamber includes a plurality of cylinder bores that receive cylinder liners. Each liner is either of a wet-sleeve design or a dry-sleeve design. Liners of a wet-sleeve design are inserted into the cylinder bore and a cooling medium is in direct contact with an outer surface of the liner. The cooling medium may be water, anti-freeze, oil and any combination thereof. In contrast, a dry-sleeve design is not in direct contact with the cooling medium. Instead, a plurality of cooling passages are cast around the cylinder bore to carry the cooling medium. The dry-sleeve design is less effective in reducing heat in the combustion chamber. Having the cooling medium in direct contact with the liner is typically more efficient and allows the engine to be operated at a higher temperature.

Despite the improved efficiency of wet-sleeve cylinder liners as compared to dry-sleeve liners, industry demands for increased horsepower require even more efficient heat removal. Traditionally, the cylinder liner is a cylindrical casing having a generally planar outer surface. Variations include projections on the outer surface. When the outer surfaces of wet-sleeved liners include projections, the liners typically form an interference fit that results in channels formed by the projections contacting a wall of the cylinder bore. These channels transport the cooling medium around the liner. Additionally, the projections are generally not arcuate in order to properly mate the projection to the wall of the bore. The limitation of having a channel to transport the cooling medium is a reduction of the outer surface of the liner in contact with the cooling medium. By limiting the cooling medium to channels that thereby adjust the flow of cooling medium around the liner; the overall efficiency of heat reduction is reduced.

Accordingly, an object of this invention is an improved wet-sleeve cylinder liner whereby heat reduction efficiency in the combustion chamber is increased.

SUMMARY OF THE INVENTION

The present invention is directed to a cooling system comprising a cylinder block having a plurality of cylinder bores forming receivers. Each bore has a fixed first predetermined diameter. Positioned into each receiver is a cylinder liner forming a combustion chamber. The liner is cylindrical and has a second predetermined diameter. The second predetermined diameter of the liner is less than the first predetermined diameter of the bore. The first predetermined diameter must be larger than the second predetermined diameter in order to properly receive the liner and a cooling medium such as water, oil or anti-freeze within the receiver.

To further improve the heat reducing efficiency of the liner, the liner of the present invention has an outer surface with a plurality of peaks and valleys. The peaks and valleys increase the overall outer surface area of the liner. The increase in surface area increases the amount of cooling medium in contact with the liner. Therefore, because more cooling medium is in contact with the outer surface of the liner, the heat reduction efficiency improves. The peaks and valleys are positioned along the entire length of the cylinder liner preferably in a generally sinusoidal pattern. More preferably, in addition to being in a generally sinusoidal pattern, the peaks and valleys are also arcuate. The arcuate shape prevents cavitation of the cooling medium and damage to the outer surface. The liner has an inner surface that remains generally planar in order to properly receive a piston.

Further features of the present invention include the casing having a first end and a second end. A flange is at the first end of the cylindrical casing. The flange is integral with the casing and is mated to a counterbore at the top of the cylinder block. The flange, when mated to the counterbore, properly positions the liner within the receiver. The second end of the liner includes a bottom and is received within the bore of the cylinder block.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
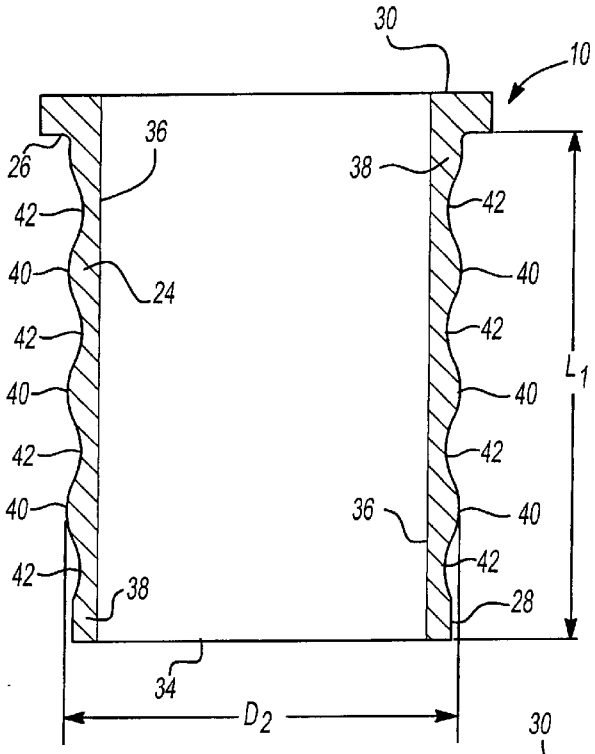
FIG. 1 is a cross-sectional view of a cylinder liner of the present invention.
Figure 2:
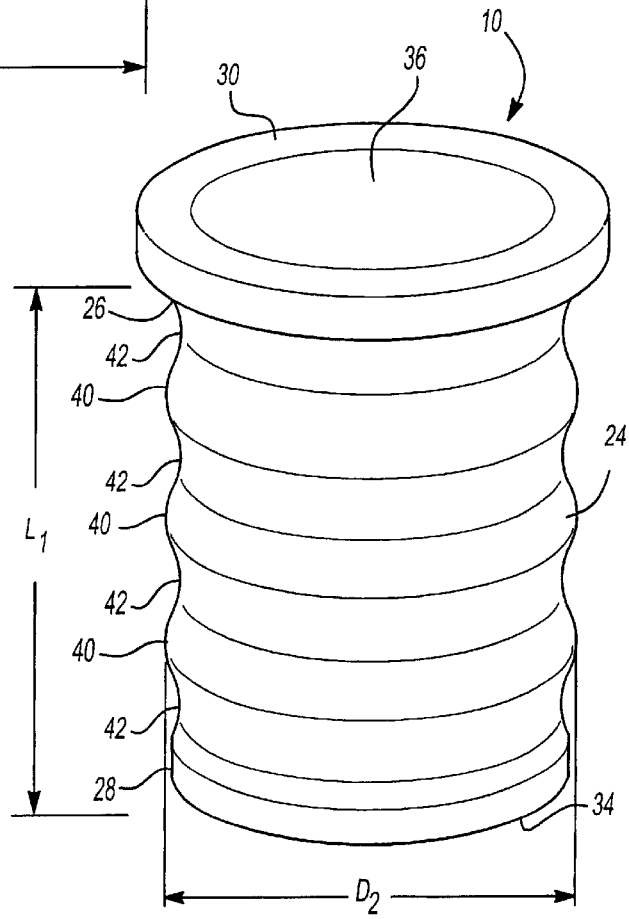
FIG. 2 is a perspective view of a cylinder liner of the present invention.
Figure 3:
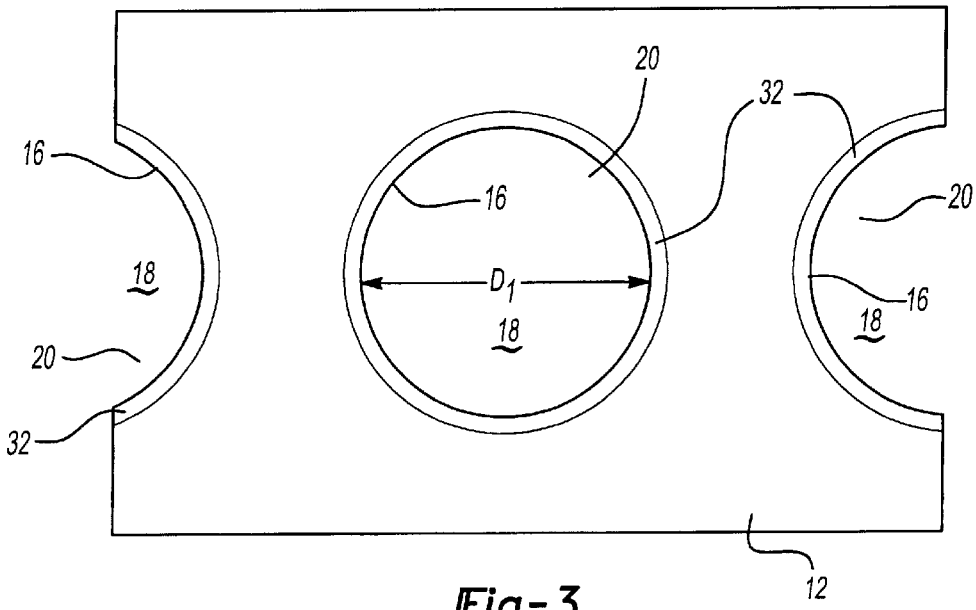
FIG. 3 is a top view of a cylinder block of an engine.
Figure 4:
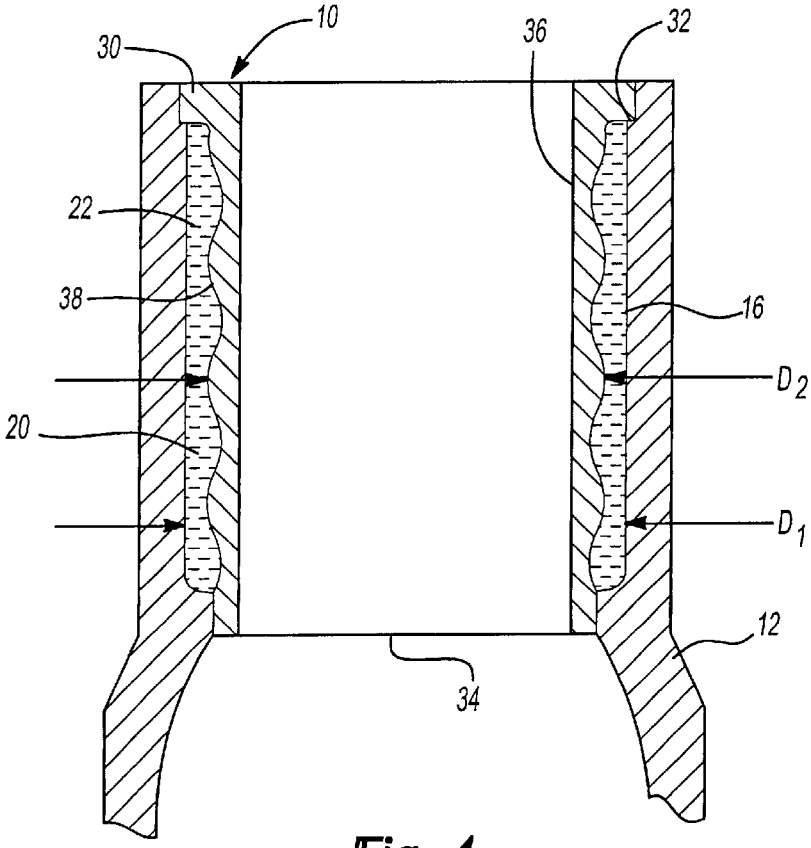
FIG. 4 is a cross-sectional view of a cylinder liner constructed in accordance with this invention in a receiver of an engine.

Referring to the drawings, a cylinder liner of a cooling system is generally referred to at 10 in FIG. 1. An engine includes a cylinder block 12 best shown in FIG. 3. Block 12 includes a plurality of receivers 20 each having cylinder walls 16 and bores 18. Bores 18 each have a first predetermined diameter $D_1$. Liner 10 is positioned in receiver 20 to form combustion chamber (not shown). Positioned within each combustion chamber is a piston (not shown). Receiver 20 is filled with fuel/air mixture and then compressed by the piston. Once compressed, the fuel is ignited by a spark plug, or in the case of a diesel engine by actual compression, to create energy and return the piston to its intake position while rotating a crankshaft (not shown). This process generates a large amount of heat. If not properly dissipated, the heat may damage various components of the engine.

In order to properly dissipate the heat, receiver 20 receives a cooling medium 22. Cooling medium 22 is typically water, but may include anti-freeze, oil or any combination thereof. The present invention is not limited to cooling medium 22 being water. To separate cooling medium 22 from the piston, liner 10 is also positioned in receiver 20.

Liner 10 of the present invention is comprised of a cylindrical casing 24 of a predetermined length $L_1$. Casing 24 includes a first end 26 and a second end 28. A flange 30 is attached to first end 26 of casing 24 and may even be integrally formed with casing 24. Flange 30 is used to properly position liner 10 within bore 18. Bore 18 of cylinder block 12 includes a counterbore 32 that mates with flange 30 of casing 24 to properly position liner 10 within receiver 20. Additionally, second end 28 includes a bottom 34. Bottom 34, along with second end 28 of casing 24, is received in receiver 20. When flange 30 is mated with counterbore 32, bottom 34 is properly positioned within bore 18 of receiver 20.

Additionally, liner 10 includes an inner surface 36 and outer surface 38 each having respective surface areas. Inner surface 36 of liner 10 is generally planar. Inner surface 36 is in contact with the piston and being generally planar is desirable for guiding the piston through its range of movement. In contrast, outer surface 38 of liner 10 is not planar but includes a plurality of peaks 40 and valleys 42.

Peaks 40 and valleys 42 in outer surface 38 of casing 24 are used to increase the surface area of outer surface 38. Increased surface area allows a greater amount of cooling medium 22 to contact outer surface 38 thereby dissipating more heat away from the combustion chamber. In a preferred embodiment, peaks 40 and valleys 42 are generally arcuate, however they may be of any shape. More preferably, peaks 40 and valleys 42 are of an arcuate shape to help to prevent cavitation of cooling medium 22. Cavitation causes disruption in cooling medium 22 and this disruption may eventually result in damage or pitting to outer surface 38. Thus, the spacing of adjacent peaks and valleys is preferably controlled to prevent cavitation. Additionally, in the preferred embodiment, arcuate peaks 40 and valleys 42 are of a generally sinusoidal pattern. The sinusoidal pattern alternates amplitudes of positive and negative. Therefore, if the amplitude of peak 40 is x, then the amplitude of valley 42 is −x. This sinusoidal pattern of arcuate peaks 40 and valleys 42 repeats along substantially entire predetermined length L1 of casing 24 that is in contact with the coolant to maximize the total surface area of outer surface 38. Furthermore, the distance between each peak 40 in the sinusoidal pattern is developed in order to create the greatest amount of surface area of outer surface 38. The desire to maximize the surface area of outer surface 38, however, must be balanced with the thickness of valleys 42. Care must be taken to avoid having valley 42 too thin as this would weaken the strength of liner 10 in receiver 20. As alternative embodiments, peaks 40 and valleys 42 may be positioned randomly along predetermined length L1 of casing 24. Furthermore, the amplitude of peaks 40 and valleys 42 may also vary from each other. Regardless of the shape and frequency of peaks 40 and valleys 42, maximizing surface area of outer surface 38 improves heat reduction by cooling medium 22 from the combustion chamber.

Cylindrical casing 24 includes a second predetermined diameter $D_2$. For receiver 20 to receive liner 10, second predetermined diameter $D_2$ must be less than first predetermined diameter $D_1$ of bore 18. A gap (not shown) results between wall 16 and outer surface 38 of liner 10 and cooling medium 22 is located therein. Second predetermined diameter $D_2$ of casing 24 is measured from the amplitudes of peaks 40. Measuring from amplitudes of peaks 40 gives the widest overall diameter of casing 24. Having a smaller second predetermined diameter $D_2$ permits the free flow of cooling medium 22 in the gap around outer surface 38 of casing 24. Additionally, having free flow of cooling medium 22 in the gap around outer surface 38 also improves heat reduction within combustion chamber 20. If second predetermined diameter $D_2$, when measured from the amplitudes of peaks 40, was equal to first predetermined diameter D1 or formed an interference fit with walls 16 of combustion chamber 20, then channels would be formed. These channels would trap cooling medium 22 and reduce the overall surface area of outer surface 38 in contact with cooling medium 22. Accordingly, the preferred embodiment of the present invention is cylinder liner 10 having peaks 40 and valleys 42 that when properly positioned within receiver 20 form the gap and do not trap cooling medium 22 in channels.

While the invention has been specifically described in connection with certain specific embodiments thereof, it is to be understood that this is by way of illustration and not of limitation, and the scope of the appended claims should be construed as broadly as the prior art will permit.

What is claimed is:

1. A cylinder liner for a cylinder bore having a first predetermined diameter comprising:

a cylindrical casing having a second predetermined diameter, wherein said second predetermined diameter is less than the first predetermined diameter of the cylinder bore, thereby forming a gap for receiving cooling medium;

an outer surface and an inner surface of said casing wherein each surface has a respective surface area, wherein substantially all of said outer surface is adapted to be exposed to the cooling medium; and a plurality of peaks and valleys positioned on said outer surface along substantially the entire length of said casing thereby increasing said surface area of said outer surface in contact with cooling medium.

2. A cylinder liner of claim 1 wherein said plurality of peaks and valleys are in a generally sinusoidal pattern positioned on said outer surface along said predetermined length of said casing.

3. A cylinder liner of claim 1 wherein said plurality of peaks and valleys are generally arcuate in order to prevent cavitation of cooling medium surrounding the liner.

4. A cylinder liner of claim 1 wherein said casing includes a first end and a flange attached to said first end of said casing for mating said liner to a counterbore of the cylinder bore.

5. A cylinder liner of claim 4 wherein said flange is integral with said casing.

6. A cylinder liner of claim 1 wherein said casing includes a second end having a bottom and said second end being received in the cylinder bore.

7. A cylinder liner of claim 1 wherein said inner surface of said liner is generally flat.

8. A cylinder liner of claim 1 wherein said plurality of peaks and valleys are positioned on said outer surface while said casing is in an uncompressed state.

9. A cooling system for an internal combustion engine comprising:

a cylinder block including a plurality of receivers each having a bore with a first predetermined diameter;

a cylinder liner being positioned in said receiver and having a second predetermined diameter being less than said first predetermined diameter of said bore; and said liner including a circumferential surface having a plurality of peaks and valleys positioned along substantially the entire length of said liner, wherein all of said peaks and valleys re arranged to be exposed to coolant medium.

10. A cooling system of claim 9 wherein said plurality of peaks and valleys are in a generally sinusoidal pattern along said surface of said predetermined length of said liner.

11. A cooling system of claim 9 wherein said peaks and valleys are generally arcuate to minimize cavitation of cooling medium surrounding said liner.

12. An engine of claim 9 including a gap between said outer surface of said liner and said cylinder block for receiving cooling medium.

13. An engine of claim 9 wherein said liner includes a first end having a flange integral therewith for mating to a counterbore of said cylinder bore.

14. An engine of claim 9 wherein said liner includes a second end having a bottom and said second end being received in said bore.

15. A cooling system for an internal combustion engine comprising:

a cylinder block including a plurality of receivers each having a cylinder wall and bore;

said bore having a first predetermined diameter;

a cylinder liner having a cylindrical casing of a predetermined length and a second predetermined diameter wherein said second predetermined diameter is less than said first predetermined diameter of said bore, thereby forming a gap for receiving a cooling medium;

an outer circumferential surface of said cylinder casing having a plurality of arcuate peaks and valleys in a generally sinusoidal pattern along said predetermined length;

a first end of said casing including a flange integral therewith for mating to a counterbore in said bore of said cylinder block;

a second end of said casing including a bottom and being received in said cylinder bore.

16. A cylinder liner for a cylinder bore having a first predetermined diameter comprising:

a cylindrical casing having a predetermined length and a second predetermined diameter, wherein said second predetermined diameter is less than the first predetermined diameter of the cylinder bore, thereby forming a gap for receiving cooling medium;

an outer surface and an inner surface of said casing wherein each surface has a respective surface area; and a plurality of peaks and valleys positioned on said outer surface of said casing while said casing is in an uncompressed state and thereby increasing said surface area of said outer surface in contact with cooling medium.

* * * * *